United States Patent [19]

Gebhardt et al.

[11] Patent Number: 4,832,276

[45] Date of Patent: May 23, 1989

[54] POLYURETHANE SLEEVE FOR TENSION REELS

[75] Inventors: Edwin J. Gebhardt; George H. Keaton; Michael M. Sinar, all of Porter, Ind.

[73] Assignee: USX Corporation, Pittsburgh, Pa.

[21] Appl. No.: 182,822

[22] Filed: Apr. 18, 1988

[51] Int. Cl.[4] ..... B65H 75/26; B65H 18/02

[52] U.S. Cl. ..... 242/78.1; 242/68.5; 242/72 R

[58] Field of Search ..... 242/78.1, 72 R, 68.5

[56] References Cited

U.S. PATENT DOCUMENTS

| | | | |
|---|---|---|---|
| 1,603,017 | 10/1926 | Biggert et al. . | |
| 2,332,293 | 10/1943 | Blodgett | 242/78.1 |
| 2,726,051 | 12/1955 | Deichert | 242/78 |
| 3,008,663 | 11/1961 | Blackman et al. | 242/67.4 |
| 3,179,245 | 4/1965 | Bastian, Jr. | 206/59 |
| 3,592,406 | 7/1971 | Martin et al. . | |
| 3,811,632 | 5/1974 | Bassett | 242/72 X |
| 4,695,008 | 9/1987 | Dabrowski | 242/68.5 |
| 4,697,757 | 10/1987 | Nakaya et al. | 242/78.1 X |

FOREIGN PATENT DOCUMENTS

| | | | |
|---|---|---|---|
| 48-19067 | 11/1973 | Japan | 242/78.1 |
| 61-012976 | 11/1986 | Japan | 242/78.1 |

*Primary Examiner*—Stuart S. Levy
*Assistant Examiner*—Steven M. duBois
*Attorney, Agent, or Firm*—W. F. Riesmeyer, III

[57] ABSTRACT

A compound elastomeric sleeve is provided for installation onto a segmented reel for preventing creases in metal strip wound into coil form thereon. A relatively thin, easily compressible outer sleeve is bonded to a thicker, more rigid inner sleeve. The dual hardness compound sleeve prevents creases yet retains its shape sufficiently for easy removal of a coil wound thereon from the reel. The invention includes a method for preventing creases from forming in metal strip which is to be wound into coil form on a segmented reel on which the compound sleeve is mounted.

5 Claims, 5 Drawing Sheets

POLYURETHANE SLEEVE FOR TENSION REELS

BACKGROUND OF THE INVENTION

The present invention relates to a sleeve for installation on a reel used to wind metal strip into coil form, and particularly to a compound sleeve for installation on an expandable and collapsible reel so as to prevent creases and other marks from occurring in the strip during winding of the coil thereon.

In the coiling of steel strip, the strip is commonly wound onto a segmented reel that can be expanded and contracted to permit alternate winding of the strip into coil form and removal of the wound coil therefrom. A problem is that creases often occur in the first few wraps of the coil especially at locations where the edge of the head end of the strip is subsequently covered by the next wraps. Creases also occur at locations where the segments are expanded since there is usually a slight gap or depression at the jointure of the segments. These gaps or depressions result in creases for several of the first wraps of the strip over the segments. Their occurrence is believed to be more prevalent when the reel becomes slightly out-of-round on expansion or slightly twisted during winding of the coil. The creases are more prominent on thinner gage strip and are especially undesirable on strip for automotive applications. Often several of the innermost wraps of the coil must be scrapped since creases are unacceptable to the customer.

It is known to use rubber or leather sleeves or boots on the segmented reel to prevent creases in the strip, however, these have been notably unsuccessful. A number of problems with the boots seemed unsolvable. The boots permitted slippage between the reel and the boot and the boot and the coil. To prevent slippage, holes were provided for bolts used to secure the boot to the reel. However, the holes left marks in the coil. Plugs were provided for the holes but tended to wear away and also result in marks subsequently. Keys were tried for attaching the boot to the reel but caused flat spots on the outer surface of the boot. Also, if the boot was soft enough to prevent head-end creases, it tended to become out-of-round upon expansion of the reel, and segment or filler bar creases still occurred at the gaps or depressions between the segments. Also, staggered coil edges sometimes resulted from the use of relatively soft, spongy boot material.

U.S. Pat. No. 3,008,663, Blackman, et al, discloses a tensioning drum D having a rubber face with oppositely inclined flexible projections formed by radially inward slits on each side of the transverse center of the drum. The use of an elastic sheet having tapered ends and placed between the inner wraps of a coil is disclosed in JA-No. 7319067. U.S. Pat. No. 3,592,406, Martin, et al, discloses a polyurethane elastomeric covering on a reel for storing steel cable. The polyurethane is 0.5 mils or more and preferably 8 to 15 mils thick and has a tensile strength of about 1600 psi. A brass facing on expandable segments of a mandrel for coiling strip is disclosed in U.S. Pat. No. 1,603,017, Biggart, et al. U.S. Pat. No. 2,726,051 discloses the use of conventional automotive brake linings on a conventional coiler reel. A plurality of metal sleeves designed to successively contract from the outer to the inner sleeve as radial pressure from winding of the coil increases are disclosed in U.S. Pat. No. 2,332,293. Finally, a core for adhesive tape is disclosed in U.S. Pat. No. 3,179,245, Bastian. The tube base may be of thermoplastic material. A collapsible synthetic resinous foam is provided over the base to permit relief of pressures built up within the roll during winding when the roll is subsequently heated to temperatures within the range of 35° to 135° C. A metal sleeve fixed to the mandrel of a coil winder is disclosed in J No. 86012976.

SUMMARY OF THE INVENTION

A compound sleeve is provided for installation onto an expandable and collapsible segmented reel so as to prevent creases from forming in metal strip wound into coil form thereon. The compound sleeve comprises concentric inner and outer sleeve sections of elastomeric material bonded together. The sleeve sections each have a hardness within the range of 50 to 95 Durometer hardness, the ratio of the Durometer hardness of the outer sleeve section to the Durometer hardness of the inner sleeve section being within the range of 0.53 to 0.95 so as to prevent creases from forming in the metal strip to be wound into coil form thereon and permit easy removal of the wound coil from the sleeve. Preferably, the hardness of the outer sleeve section is within the range of 50 to 70 Durometer, and the hardness of said inner sleeve section is within the range of 75 to 95 Durometer.

DESCRIPTION OF THE PREFERRED EMBODIMENT

Figure 1:
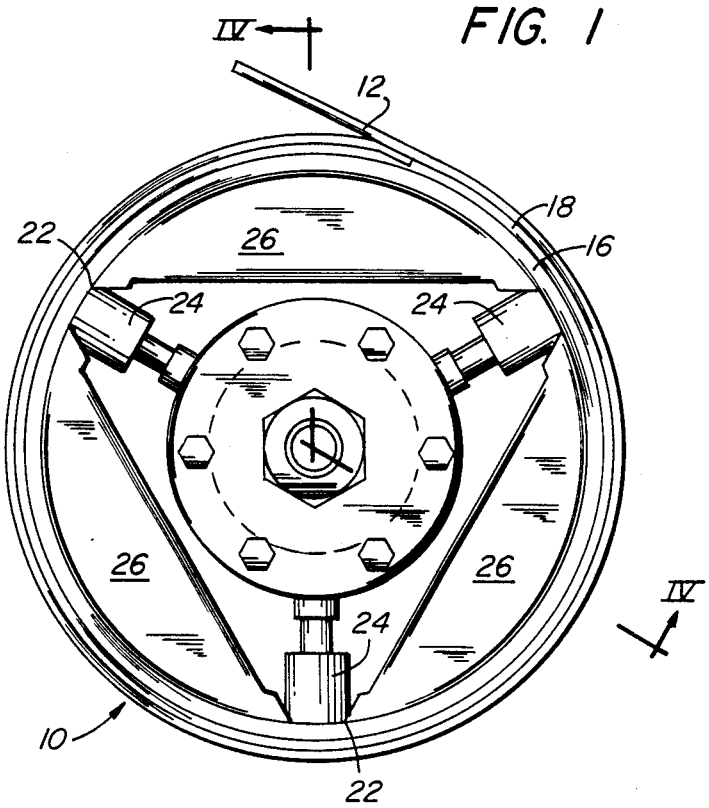
FIG. 1 is a side elevational view of a segmented expandable and collapsible reel having a compound sleeve of the present invention installed thereon.
Figure 2:
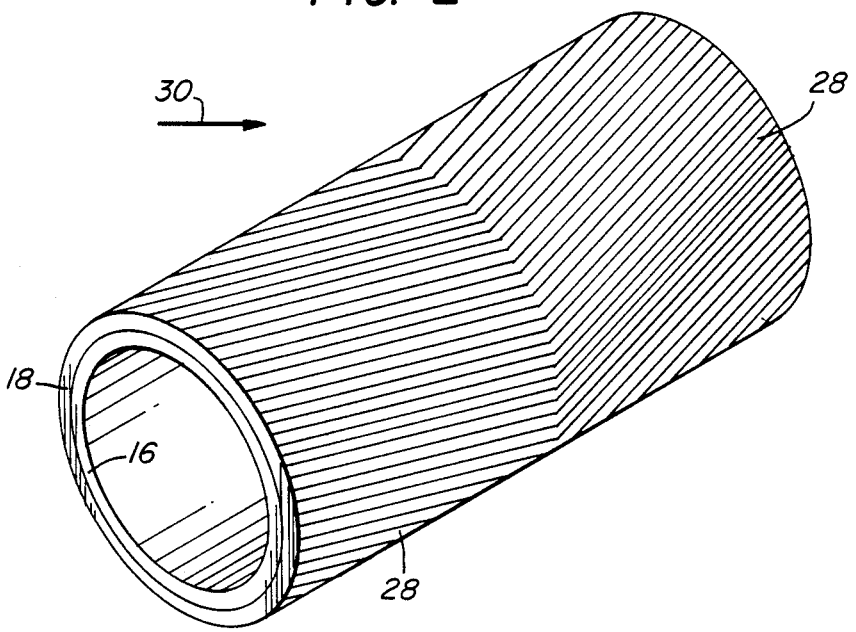
FIG. 2 is an isometric view of a compound sleeve of the invention showing herringbone slits in the outer surface thereof.

Referring to FIG. 1, a reel 10 for coiling metal strip 12 has a compound sleeve 14 comprised of inner and outer concentric sleeve sections 16 and 18 mounted thereon. The reel is of conventional type and will be described more fully below in connection with the method of using the compound sleeve. According to the invention, the compound sleeve, as illustrated more completely in FIG. 2, includes inner and outer concentric sleeve sections 16 and 18 of elastomeric material. The sleeve sections are bonded together in conventional fashion at their adjoining surfaces by well known methods of manufacture. For example, a liquid elastomeric material may be poured into a mold holding the cured inner sleeve section. The surface of the cured inner sleeve section may be coated with a bonding agent to enhance the degree of adhesion of the sleeve section surfaces. The sleeve sections should have a hardness within the range of 50 to 95 Durometer. It is essential that the inner sleeve section has a higher hardness than the outer sleeve section such that the ratio of the Durometer hardness of the outer sleeve section to that of the inner sleeve section is within the range of 0.53 to 0.95. The relatively soft outer sleeve section compresses sufficiently at the location of head end of the strip so as to prevent creases from forming at that location in subsequent wraps of the strip wound thereover. Preferably, to accomplish this, the outer sleeve section should have a thickness at least 8 times the thickness of the metal strip to be wound. Generally, the thickness of the outer sleeve section should be within the range of 0.020 to 0.500 inches. The inner sleeve section on the other hand is relatively harder than the other sleeve section to permit easier removal of a full wound coil thereon from the reel. It should be noted that the sleeve remains on the reel. The relatively hard inner sleeve section does not collapse when a coil is wound onto the sleeve. Collapse of the sleeve causes problems in stripping the coil from the reel. Also, the relatively hard inner sleeve section prevents creases from forming in wraps of the metal strip wound over locations of joints 22 between filler blocks 24 and expandable segments 26 of the reel. Preferably, the inner sleeve section has a thickness within the range of 0.25 to 1.50 inches to provide sufficient strength for the above-mentioned purposes. Generally, for use on existing reels in the metal producing industry the compound sleeve should have an outer diameter within the range of 20 to 30 inches and an inner diameter within the range of 18 to 28 inches. Most preferably the inner and outer sleeve sections are of polyurethane material. Polyurethane does not absorb oil from the strip and is not adversely effected by it. It is also preferred that slits 28 (FIG. 2) be provided in the outer surface of the outer sleeve section to permit oil to flow off the strip and prevent slippage between the strip and the sleeve. More preferably, the slits should be cut into the sleeve to a depth within the range of 0.100 to 0.200 inches and a width within the range of 0.05 to 0.125 inches. Slits arranged in herringbone shape, as illustrated in FIG. 2, are preferred with the slits pointing in the direction 30 of travel of the strip to be wound on the sleeve. The slits should be parallel and spaced apart at a distance within the range of 0.5 to 1.25 inches with respect to each other in a transverse direction.

Figure 3:
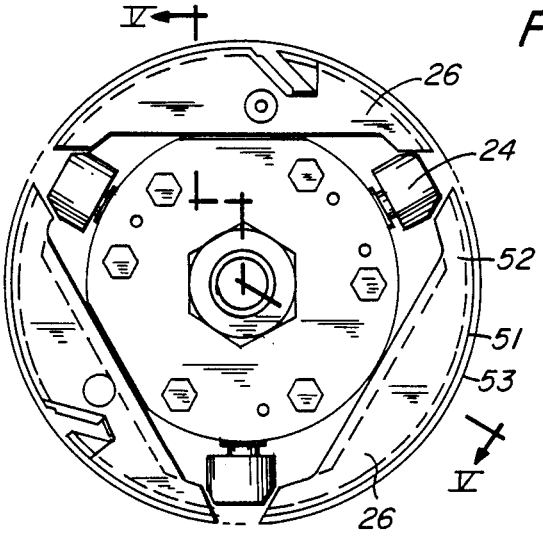
FIG. 3 is a side elevational view of the reel of FIG. 1 in the normal collapsed position with the compound sleeve removed.
Figure 6:
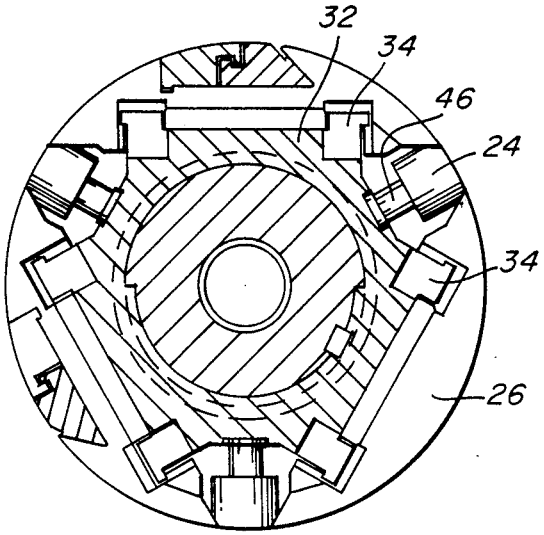
FIG. 6 is a section taken at VI—VI of FIG. 4.
Figure 7:
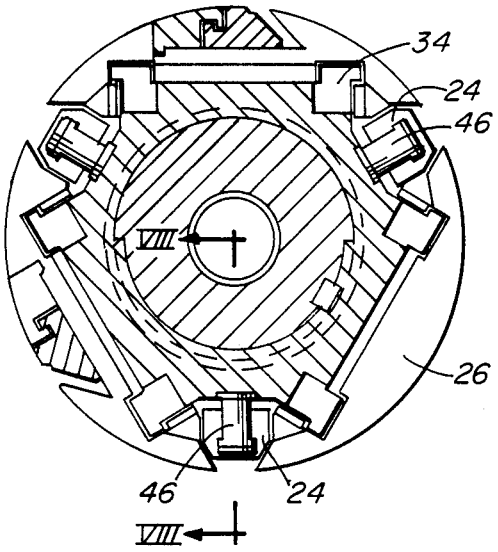
FIG. 7 is a section taken at VII—VII of FIG. 5.
Figure 4:
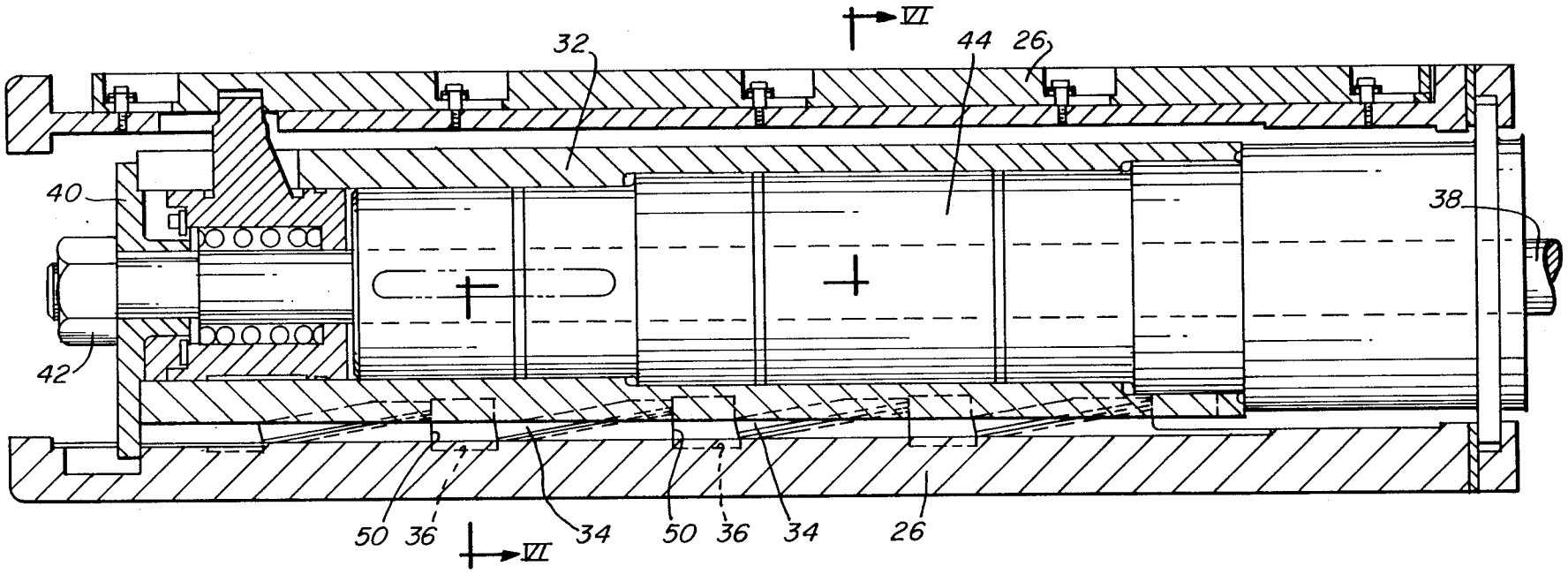
FIG. 4 is a section taken at IV—IV of FIG. 1 with the compound sleeve removed.
Figure 5:
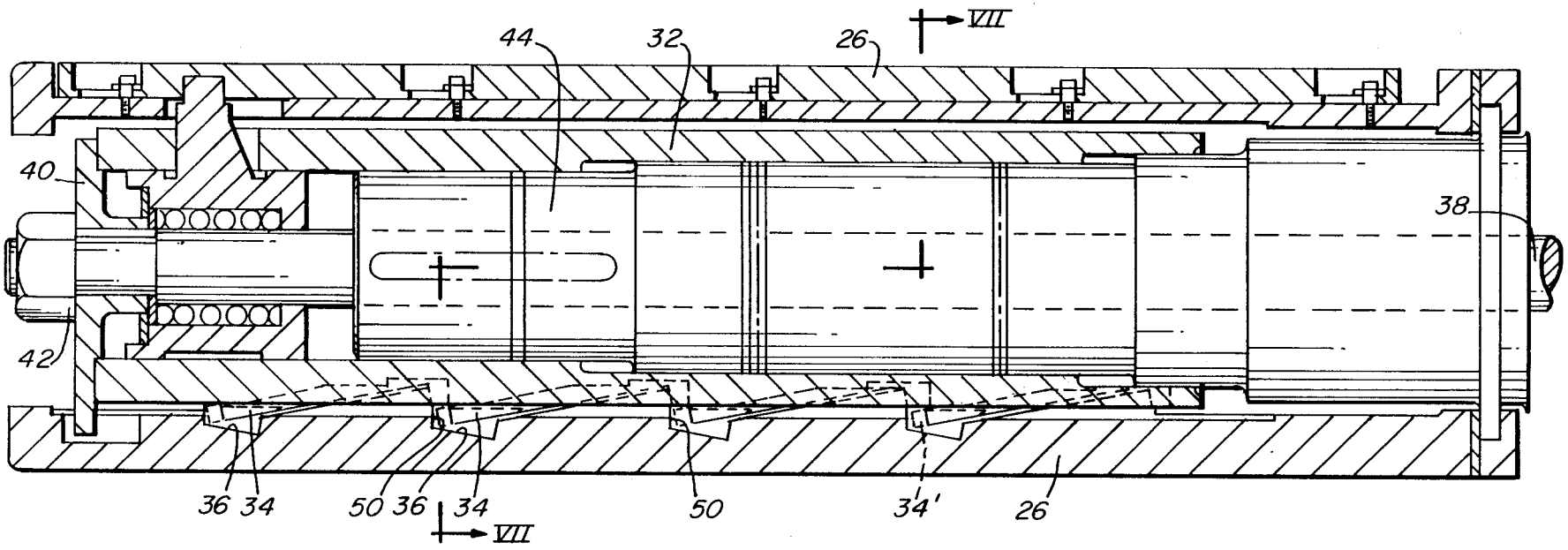
FIG. 5 is a section taken at V—V of FIG. 3.
Figure 8:
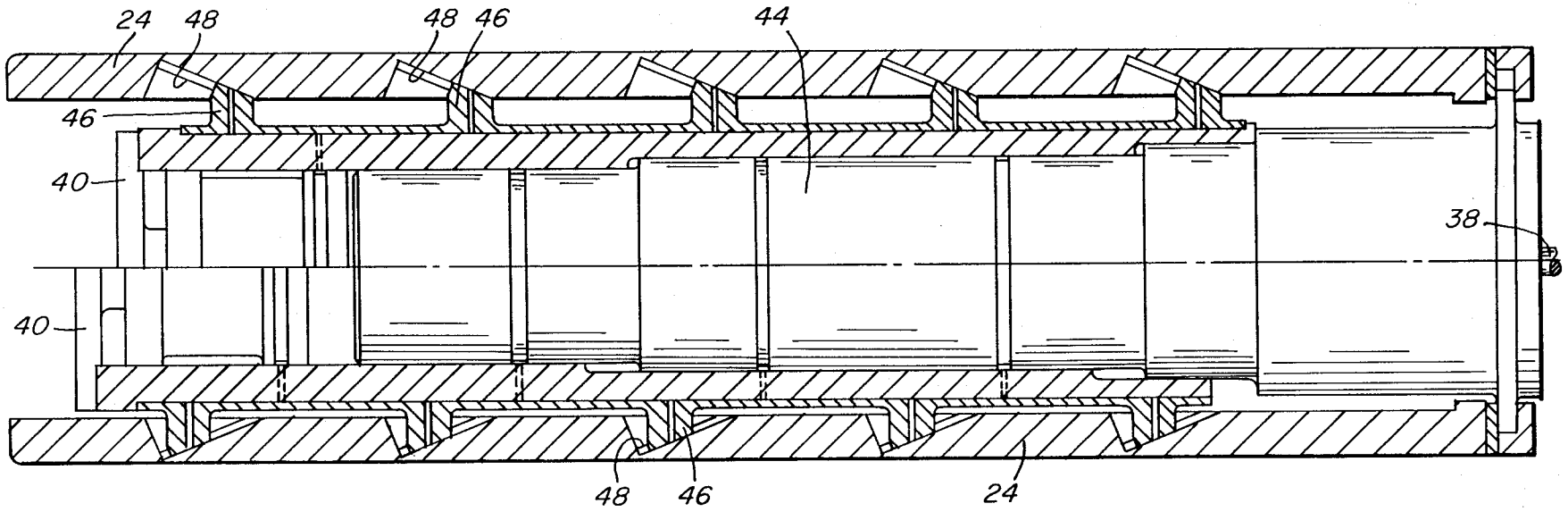
FIG. 8 is a section taken at VIII—VIII of FIG. 7.

The invention also includes a method for installing the compound sleeve on a conventional expandable and collapsible reel and winding metal strip into coil form thereon. Referring to FIG. 1, conventional reel 10 includes expandable segments 26 separated by filler blocks 24. Each segment is slidably mounted on spreader 32 (FIG. 6). The spreader has a plurality of wedge shaped protrusions 34 (FIG. 5) slidably engaging mateably shaped slots 36 in each segment. Spreader 32 is secured to reciprocable pull rod 38 by end plate 40 and nut 42. Spreader 32 is slidably mounted on mandrel 44. Filler blocks 24 (FIGS. 6 and 8) are slidably mounted on wedge blocks 46 which ride in wedge shaped slots 48 of each filler block. Wedge blocks 46, in turn, are secured to spreader 32. Reciprocation of pull rod 38 back and forth in the axial direction by cylinder means (not shown) causes alternate expansion of the segments and filler blocks to the position shown in FIGS. 1, 4 and 6, and the lower half of FIG. 8, and collapse of the segments and filler blocks to the position shown in FIGS. 3, 5 and 7, and the upper half of FIG. 8. According to the method of this invention, nut 42 is loosened (or removed) and spreader 32 is manually moved to the left, as shown in FIG. 5, so that wedge shaped protrusions 34 of the spreader become fully seated as shown by dotted lines 34' against rear surfaces 50 of slots 36 in each segment. This movement causes the segments to further collapse from a "normal" collapsed position 51 shown by heavy lines in FIG. 3 to a "super-collapsed" position 52, illustrated in dotted lines therein. The difference in diameter of the reel between the collapsed and super-collapsed positions is about 0.2 inch. With the reel in super-collapsed position, we install the compound sleeve of this invention thereon. The compound sleeve is designed to have an inner diameter intermediate that of the diameter of the reel in the collapsed and super-collapsed positions. Preferably, the sleeve has an inner diameter midway between the difference in reel diameters in the aforementioned positions, e.g. 0.1 inch greater than the collapsed diameter of our particular reel. Subsequently, we tighten nut 42 so as to again secure pull rod 38 to the spreader. This automatically moves segments 26 and filler blocks 24 back to a normal collapsed position tightening the reel against compound sleeve 14. Then spreader 32 is moved to the right in FIG. 4 by retraction of the cylinder means and pull rod 38 so that the segments and filler blocks move to the expanded position 53 as shown in FIG. 3. This further tightens the compound sleeve on reel 10 and permits metal strip 12 to be wound on the reel without the formation of creases in the strip.

We claim:

1. A compound sleeve for installation onto an expandable and collapsible segmented reel so as to prevent creases from forming in metal strip wound into coil form thereon, said sleeve comprising:

inner and outer concentric sleeve section of elastomeric material bounded together, said sleeve sections each having a hardness within the range of 50 to 95 Durometer hardness, the ratio of the Durometer hardness of said outer sleeve section to the Durometer hardness of said inner sleeve section being within the range of 0.53 to 0.95 so as to prevent creases from forming in the metal strip to be wound into coil form thereon, wherein said outer sleeve has a plurality of spaced slits arranged in herringbone shape thereon, said herringbone slits pointing in the direction of travel of the strip to be wound onto said sleeve, said herringbone slits pointing toward a central transverse plane of the sleeve.

2. The compound sleeve of claim 1, wherein said slits are spaced apart in a transverse direction at a distance within the range of 0.5 to 1.25 inches.

3. The compound sleeve of claim 2, wherein said slits have a depth within the range of 0.100 to 0.200 inches and a width within the range of 0.05 to 0.125 inches.

4. A method for preventing creases from forming in metal strip which is to be wound into coil form onto an expandable and collapsible segmented reel, said reel including a plurality of outer segments and means connected to said segments for the expansion and collapse thereof, said method comprising:

at least partially disconnecting said expansion means from said segments, then manually moving said segments to a super-collapsed position, installing a compound sleeve onto the segments of said reel while said segments are in the super-collapsed position, said compound sleeve including inner and outer concentric sleeve sections of elastomeric material bonded together, said sleeve sections each having a hardness within the range of 50 to 95 Durometer, the ratio of the Durometer hardness of said outer sleeve section to the Durometer hardness of said inner sleeve section being within the range of 0.53 to 0.95 so as to prevent creases from forming in the metal strip to be wound into coil form thereon, reconnecting said expansion means to the segments after installation of the sleeve thereon so as to move said segments to a normal collapsed position, subsequently moving said expansion means so as to spread the segments to an expanded position, and then winding the metal strip into coil form onto said sleeve on the reel.

5. The method of claim 4, wherein, upon reconnecting said expansion means to the segments, said step includes tightening said segments against the inner periphery of said compound sleeve.

* * * * *